United States Patent [19]

Yamamoto

[11] Patent Number: 4,835,052

[45] Date of Patent: May 30, 1989

[54] ABRASIVE SHEET WITH THE SURFACE OF THE ABRASIVE PARTICLES CLEANED AND METHOD OF MAKING

[75] Inventor: Motokazu Yamamoto, Tokyo, Japan

[73] Assignee: Hi-Control Limited, Hong Kong

[21] Appl. No.: 158,251

[22] Filed: Feb. 18, 1988

[51] Int. Cl.[4] ..... B32B 5/16

[52] U.S. Cl. ..... 428/332; 427/336; 427/348; 427/427; 428/402; 428/698; 428/702

[58] Field of Search ..... 427/336, 348, 427; 428/332, 402, 698, 702

*Primary Examiner*—Bernard Pianalto

*Attorney, Agent, or Firm*—Ladas & Parry

[57] ABSTRACT

A process for preparing an abrasive sheet comprising (a) mixing abrasive particles with an adhesive resin to form a slurry, and stirring the slurry (b) painting the slurry uniformly on a base sheet (c) permitting the slurry to dry and harden (d) spraying the abrasive sheet with an organic solvent (e) immediately thereafter spraying the surface of the abrasive sheet with compressed air of nitrogen gas.

18 Claims, 2 Drawing Sheets

ABRASIVE SHEET WITH THE SURFACE OF THE ABRASIVE PARTICLES CLEANED AND METHOD OF MAKING

BACKGROUND OF THE INVENTION

1. Field of the Invention

The present invention relates to the abrasive sheet for the clean abrasion of the surface of an object.

2. Description of the Prior Art

In the traditional abrasive sheet as is shown in FIG. 1, abrasive particles 3 such as aluminum oxide ($Al_2O_3$), chromium oxide ($Cr_2O_3$) or silicon carbide (SiC) are mixed with polyester resin adhesive as a binder 4 and a hardener, the mixture is Stirred up and painted uniformly on a polyester sheet 1 to be dried and hardened. The abrasive sheet produced by this process has a coating of the resin binder 5 on the surface of the abrasive particles in the abrasive layer 2. When polishing silicon wafers for semiconductor device elements with an abrasive sheet as in the prior art, the resin binder 5 coating on the abrasive particles is melted by the heat generated locally by friction and adheres to the wafers. After such thermal melt, carbon impurity adheres to the wafers and is hard to remove. Moreover, hard computer discs are prepared by electro-plating Ni-P on an aluminum base after which iron or chromium is electroplated or sputtered onto the Ni-P. If the surface of the Ni-P is abraded with the traditional abrasive sheet, the binder resin would adhere to the hard discs and degrade their magnetic properties.

The instant invention relates to the discovery that one must remove the binder resin 5 coating from the surface of the abrasive particles of the traditional abrasive sheet in order to eliminate the magnetic degradation or adherence of impurities to the abraded surface.

SUMMARY OF THE INVENTION

An object of the present invention is to provide an abrasive sheet having a clean abrasive particles surface.

Another object of the invention is to provide a process for preparing an abrasive sheet with the abrasive surface free of resin adhesive.

The process for preparing the adhesive sheet of the present invention involves utilizing the prior art apparatus (FIG. 2) for preparing a traditional abrasive sheet added and adding the cleaning apparatus (FIG. 3) for cleaning the surface of the abrasive particles.

The process for producing the novel abrasive sheet involves spraying organic solvent and gas on the abrasive sheet after the final stage of production of the traditional (prior art) sheet, in order to wash and blow off the binder resin coating the surface of the abrasive particles of the abrasive layer.

DETAILED DESCRIPTION OF THE PRESENTLY PREFERRED EMBODIMENTS

Figure 2:
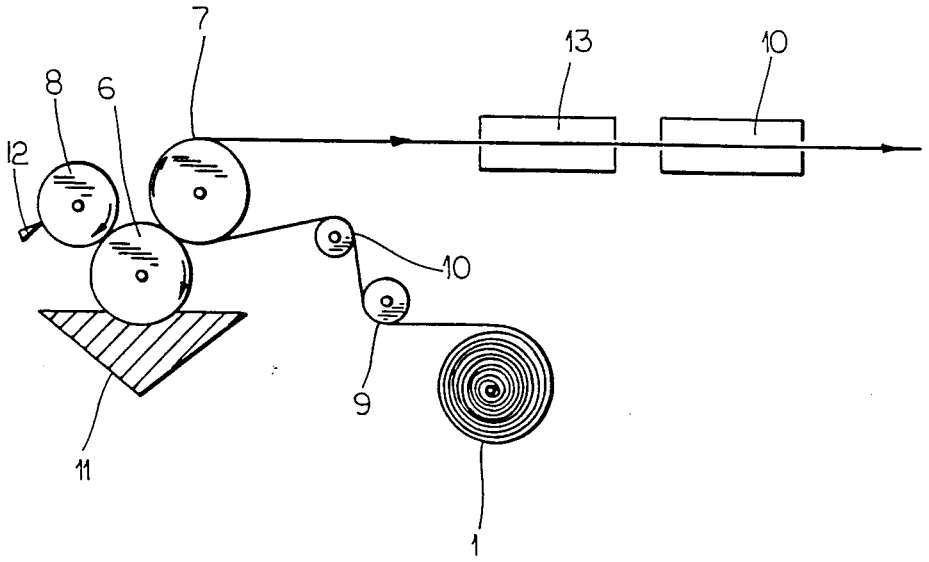
PRIOR ART FIG. 2
FIG. 2 is a schematic view of the apparatus for producing of the prior art abrasive sheet.

FIG. 2 shows the apparatus for producing the traditional (prior art) abrasive sheet.

In FIG. 2, the polyester sheet 1 rolled round the drum is led to the painting rollers 6, 7 and 8 by the guide rollers 9 and 10, and painted uniformly with the slurry that is the mixture of the adhesive and abrasive particles in the vat 11. The roller 8 works to make the thickness of the abrasive layer uniform.

The doctor blade 12 removes the slurry adhering to the roller 8. The Sheet, painted uniformly with the slurry, is put into the low temperature dryer 13 at a temperature of 90°-100° C. Drying the sheet at low temperature avoids inadequate drying of the inside (with only the surface resin being dried) and its inside is not adequately dried due to a fast dry. Next, the sheet is put into the high temperature dryer at a temperature of 105°-125° C.

Thus, the drying process of the slurry is completed, and the abrasive layer is formed on the polyester sheet.

Aluminum oxide ($Al_2O_3$), chromium oxide ($Cr_2O_3$) or silicon carbide (SiC) with its average diameter 1-30 μm may be used as the abrasive material.

A polyester resin is dissolved into the solvent mixture, and a hardener is added to provide the binder adhesive. The viscosity of the slurry, (the mixture of the abrasive particles and binder adhesive) is from 400 to 600 cp. The slurry is dried on the surface of the base polyester sheet (with thickness of 16-100 μm) and forms the abrasive layer with a thickness of from 10 to 20 μm.

Figure 1:
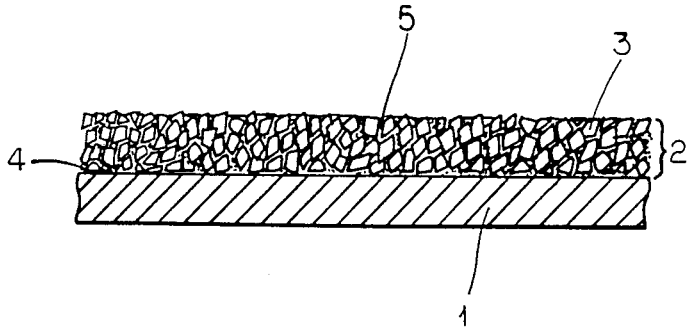
PRIOR ART FIG. 1
FIG. 1 shows the prior art abrasive sheet.

FIG. 1 shows the traditional (prior art) abrasive sheet produced as mentioned above, and 1 is the polyester base sheet, 2 is the abrasive layer, 3 is the abrasive particle and 4 is the adhesive resin as the binder.

On abrasion of an object, the surface of the abrasive particles of the traditional (prior art) abrasive sheet are coated with the binder resin. The instant invention avoids this.

Figure 3:
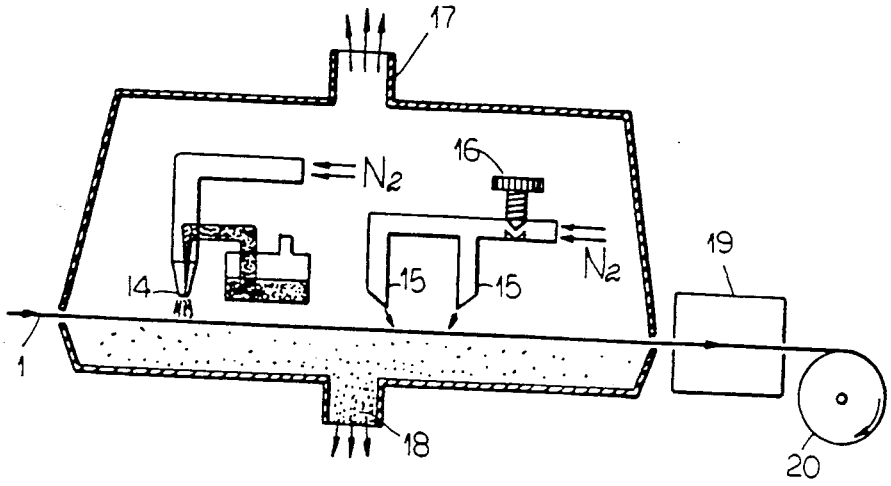
FIG. 3 shows the apparatus for cleaning the surface of the abrasive particles of the present invention.

In accordance with the invention the traditional abrasive sheet 1 produced by the abrasive sheet producing apparatus is put into the abrasive particle surface cleaning apparatus as is shown in FIG. 3. Number 14 in FIG. 3 is a nozzle to spray the organic solvent to dissolve the resin binder, with nitrogen gas or compressed air. The organic solvent used is preferably but not limited to a mixed solvent of 41.7% toluene, 16.7% xylene, 8.3% ethyl acetate and 33.3% methyl ethyl ketone. Another favored solvent mixture is acetone, methyl isobutyl ketone or methyl butyl ketone, cyclohexanone or cyclohexane and butyl acetate, preferably, 41.3-42.7% acetone, 32.5-33.5% methyl isobutyl ketone or methy butyl ketone 17.5-15.9% cyclohexanone or cyclohexane and 7.9-8.7% butyl acetate. In accordance with the invention the slurry on the abrasive sheet is dried up completely and formed into the abrasive layer, and only the resin binder on the surface of the abrasive layer is locally dissolved again by the spray of the organic solvent. Immediately after spraying with organic solvent, the gas jet 15 shown in FIG. 3 is sprayed to blow off the resin binder coating the surface of the abrasive particles. Number 16 is the valve to control the pressure of the jet gas. The gas used is nitrogen gas or compressed air. Number 17 is the exhaust duct to discharge the organic solvent vapor and the dust of said resin binder blown off. Number 18 is the outlet of the organic solvent. Number 19 is the dryer and 20 is the roller.

Figure 4:
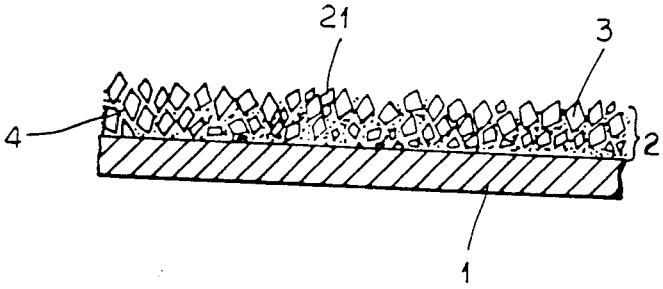
FIG. 4 shows the abrasive sheet of the instant invention after surface of its abrasive particles have been cleaned.

FIG. 4 shows the abrasive sheet with the surface of the abrasive particles cleaned by the process of the invention. Number 1 is the polyester base sheet base, 2 is the abrasive layer, 3 is the abrasive particles, 4 is the resin under adhesive and 21 is the abrasive particles exposed on the surface of the abrasive layer after cleaning.

While the speed at which a traditional abrasive sheet 1 passes through the apparatus described in FIG. 3 may be varied, if it is slow, the quantity of blow-off of the resin binder of abrasive layer will increase for two reasons; (1) the organic solvent sprayed from the nozzle 14 in FIG. 3 takes longer time for osmosing from the surface of abrasive layer on the sheet and, consequently, osmoses more deeply into the depth of the layer and (2) the time of blow-off of the resin binder by the gas jet from the nozzles 15 in FIG. 3 is liable to be longer. Conversely, the quantity of blow-off of resin binder will become smaller, if the sheet passes through the apparatus faster. The speed of the sheet, and consequently, the amount of time in which the abrasive sheet is subject to blow-off may be varied.

In the present apparatus the speed of the sheet is varied from 3 cm/sec to 15 cm/sec. Since the distance between nozzles 15 in FIG. 3 in this apparatus happens to be 45 cm, the span of time in which the sheet is blown-off by the gas is for example, approximately 15 sec. to 3 sec. In a standard manufacturing process, the moving speed of the sheet may be, for example about 10 cm/sec and, consequently, the span of time in which the abrasive layer is blown-off by gas jet is approximately 4.5 sec.

With respect to the pressure of the gas jet, the pressure of gas in the instant apparatus may be varied, preferably from 1.1 through 1.6 atm (atmospheric pressure). The hard discs of computers cleaned by adhesive sheets prepared by the present invention were compared with hard discs cleaned with the traditional abrasive sheet in respect of their magnetic properties. The results of this comparison showed that there were no problems with the disks cleaned by the adhesive sheets of the invention, but the magnetic properties were poor in the disks cleaned with the traditional abrasive sheet.

It will thus be seen that the objects of the invention set forth above, made apparent from the preceding description are efficiently attained and since certain changes may be made in the above articles without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language might be said to fall there between.

I claim:

1. A process for preparing an abrasive sheet comprising (a) mixing abrasive particles with an adhesive resin to form a slurry, and stirring the slurry (b) painting the slurry uniformly on base sheet (c) permitting the slurry to dry and harden (d) spraying the abrasive sheet with an organic solvent (e) immediately thereafter spraying the surface of the abrasive sheet with compressed air or nitrogen gas.

2. The process as in claim 1, wherein the abrasive particles are selected from one or more of the group consisting of $Al_2O_3$, $Cr_2O_3$, and SiC with a particle size of from 1–30 μm.

3. The process, as in claim 2, wherein the base sheet comprises a polyester sheet.

4. The process as in claim 3 wherein the viscosity of the slurry comprises 400–600 cp.

5. The process as in claim 4 wherein the abrasive layer comprises a layer with a thickness of 10–20 μm.

6. The process as in claim 1 wherein the organic solvent comprises a mixture of toluene, xylene, ethyl acetate and methyl ethyl ketone.

7. The process, as in claim 6 wherein the solvent mixture comprises from 41.3 to 42.7% toluene, from 32.5 to 33.5% methyl ethyl ketone, from 15.9 to 17.5% xylene and from 7.9 to 8.7% ethyl acetate.

8. The process as in claim 7 wherein the solvent mixture comprises 41.7% toluene, 33.3% methyl ethyl ketone, 16.7% xylene and 8.3% ethyl acetate.

9. The process, as in claim 1 wherein the spraying of the surface of the abrasive sheet with compressed air or nitrogen occurs for a period of 3–15 seconds.

10. The process, as in claim 9 wherein the solvent mixture comprises 41.3–42.7% acetate, 32.5–33.5% methyl isobutyl ketone or methyl butyl ketone, and 159–17.5% cyclohexanone or cyclohexane, and 7.9–8.7% butyl acetate.

11. The process, as in claim 9 wherein the spraying occurs for about 4.5 seconds.

12. The process, as in claim 1 wherein the organic solvent is sprayed with a gas jet having a pressure of 1.1–1.6 atm.

13. The process, as in claim 12 wherein the pressure is 1.5 atm.

14. An abrasive sheet, prepared by (a) mixing abrasive particles with an adhesive resin to form a slurry, and stirring the slurry.

(b) painting the slurry uniformly on a base sheet (c) permitting the slurry to dry and harden (d) spraying the abrasive sheet with an organic solvent (e) immediately thereafter spraying the surface of the abrasive sheet with compressed air or nitrogen gas.

15. The abrasive sheet, as in claim 14 wherein the abrasive particles are selected from one or more of the group consisting of $Al_2O_3$, $Cr_2O_3$, and SiC with a particle size of from 1–30 μm.

16. The abrasive sheet, as in claim 14 wherein the organic solvent comprises a mixture of toluene, xylene, ethyl acetate and methyl ethyl ketone.

17. The abrasive sheet as in claim 16 wherein the solvent mixture comprises 41.7% toluene, 33.3% methyl ethyl ketone, 16.7% xylene and 8.3% ethyl acetate.

18. The process, as in claim 1 wherein the organic solvent comprises a solvent mixture of one of the group consisting of acetone, methyl isobutyl ketone, cyclohexanone and butyl acetate; a mixture of the acetone, methyl butyl ketone, cyclohexanone, and butyl acetate; acetone, methyl isobutyl ketone, cyclohexane and butyl acetate; and methyl butyl ketone, cyclohexane and butyl acetate.

* * * * *